US005080024A

United States Patent [19]

Yamamoto

[11] Patent Number: 5,080,024

[45] Date of Patent: Jan. 14, 1992

[54] FOLDABLE WORKBENCH

[76] Inventor: Eiji Yamamoto, 244-1, Akada, Okayama-shi, Okayama-ken, Japan

[21] Appl. No.: 676,800

[22] Filed: Mar. 28, 1991

[30] Foreign Application Priority Data

Mar. 30, 1990 [JP] Japan ..... 2-35246[U]

[51] Int. Cl.[5] ..... A47B 3/02

[52] U.S. Cl. ..... 108/116; 108/112

[58] Field of Search ..... 108/116, 112, 114; 248/165, 434; 211/195, 198, 199

[56] References Cited

U.S. PATENT DOCUMENTS

| | | | |
|---|---|---|---|
| 89,131 | 4/1869 | Daggett | 211/199 X |
| 742,394 | 10/1903 | Churchill | 211/199 |
| 2,978,754 | 4/1961 | Wilson | 108/112 |
| 3,080,193 | 3/1963 | Nimmo | 108/112 X |
| 3,138,122 | 6/1964 | Mondineu | 108/112 |
| 3,351,029 | 11/1967 | Bue | 108/112 |
| 3,476,061 | 11/1969 | Takahashi | 108/112 |
| 4,949,649 | 8/1990 | Terres et al. | 108/116 |

*Primary Examiner*—Peter A. Aschenbrenner
*Attorney, Agent, or Firm*—Koda & Androlia

[57] ABSTRACT

A foldable workbench made of a pair of U-shaped (when viewed from the above) frame works connected to each other, each frame work being formed with rear frame section and two side frame sections which are pivotally connected to the rear frame section so that the two side frames can be folded one on the other. A top panel is pivotally connected to the upper end of the rear frame section so as to be raised to a horizontal position. The height of vertical posts that make the frame work is adjustable by way of locks inserted into holes opened in the posts.

1 Claim, 3 Drawing Sheets

FOLDABLE WORKBENCH

BACKGROUND OF THE INVENTION

1. Field of the Invention

The present invention relates to a foldable and height-adjustable workbench.

2. Prior Art

There are conventional workbenches which are not only foldable but also height-adjustable. In this type of workbenches, telescopic legs, which can cut off the transmission of vertical load of the workbench, and a folding top panel, which takes a reaction force from components other than the telescopic legs, are linked by a restraining motion used for opening. As a result, a desired height is obtained in one-touch operation without extending the telescopic legs which is impeded as a result of the weight of the top panel.

However, when such a workbench is folded, the top panel, which splits into two halves, are folded in the direction of "−" moment (or downward) so that it assumes an upright position. When the top panel is folded, the telescopic legs of a stand (which supports the folded workbench) project to the right and left. Thus, the workbench cannot be turned on its side so as to be stored in a horizontal stacking manner.

Furthermore, the links used for opening the top panel tend to be complicated. Moreover, since the overall weight of the workbench and the stand for supporting the workbench is large, a considerable force is required to assemble the workbench, needing usually two people for such assembling job.

SUMMARY OF THE INVENTION

Accordingly, in order to solve the problems, the foldable workbench of the present invention takes a unique structure wherein a unit bench is constructed with a U-shaped (when viewed from the top) unit frame that comprises a rear frame and two side frames, the unit frame being made of four telescopic posts (with casters at the bottom ends) and lateral bars which connect the posts. Hinges are installed on the lateral bar that connects the two posts of the rear frame in a manner that two side frames are folded on the rear frame one on the other. A horizontal brace is provided between the two telescopic posts of the rear frame so that the two posts are connected to each other, and brackets are projected near the upper end of the rear frame posts so that a top panel is pivotally mounted to the brackets.

A pair of thus structured unit benches are connected in a back-to-back fashion, with the corresponding braces and horizontal bars of the rear frame of each unit bench being formed as a single integral part, and a gas-spring-equipped diagonal brace frame is installed between the horizontal braces and the lateral bars.

DETAILED DESCRIPTION OF THE INVENTION

Figure 2:
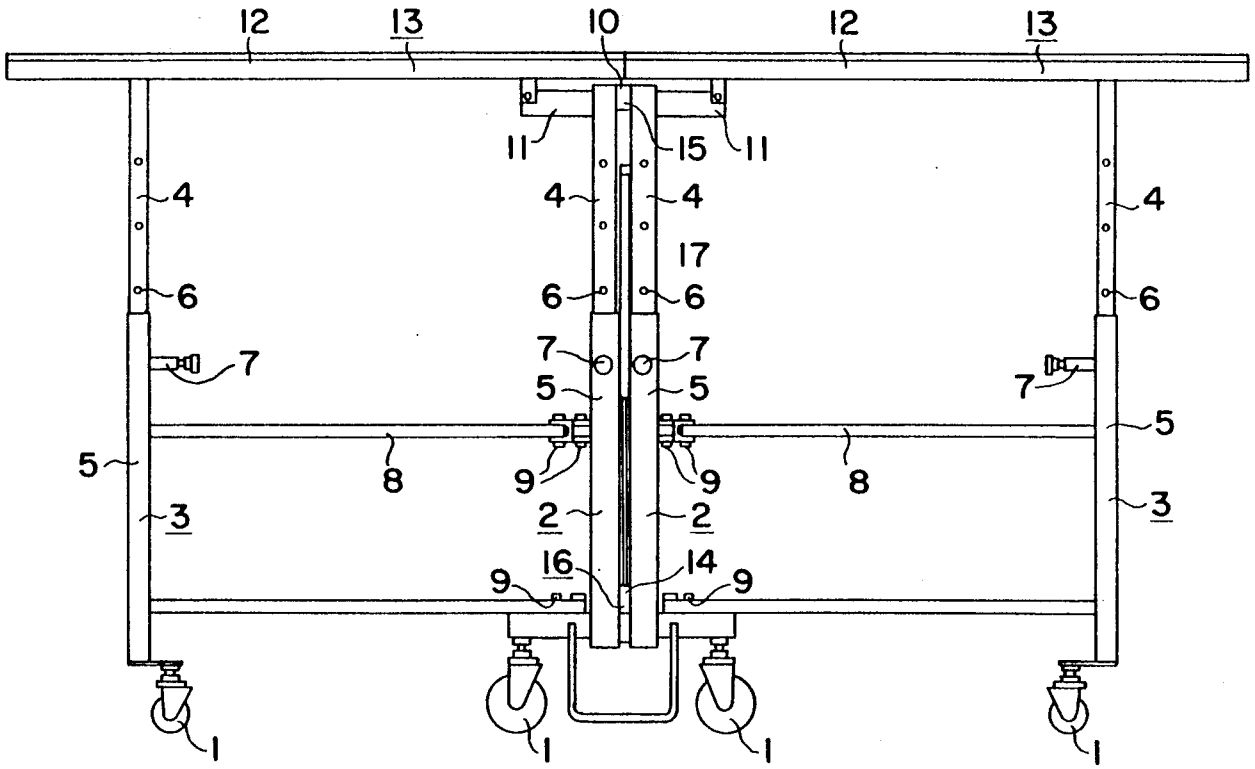
FIG. 2 is a front view of the assembled workbench.

One embodiment of the foldable workbench of the present invention will be described with reference to the accompanying drawings.

Four telescopic posts 2, 2', 3 and 3' which have casters 1 at the bottom ends are used. Each telescopic post consists of an inner cylinder 4 and an outer cylinder 5. The inner cylinder 4 has a plurality of latch holes 6 opened in it with a fixed interval, and a bolt 7 which fits into the latch holes 6 is screwed into the outer cylinder 5. The height of the post is changed by inserting the bolt 7 into the desired latch holes.

These four telescopic posts are connected by horizontal bars, thus forming a U-shaped frame (when viewed from the top) which consists of one rear frame section and two side frame sections.

Figure 4:
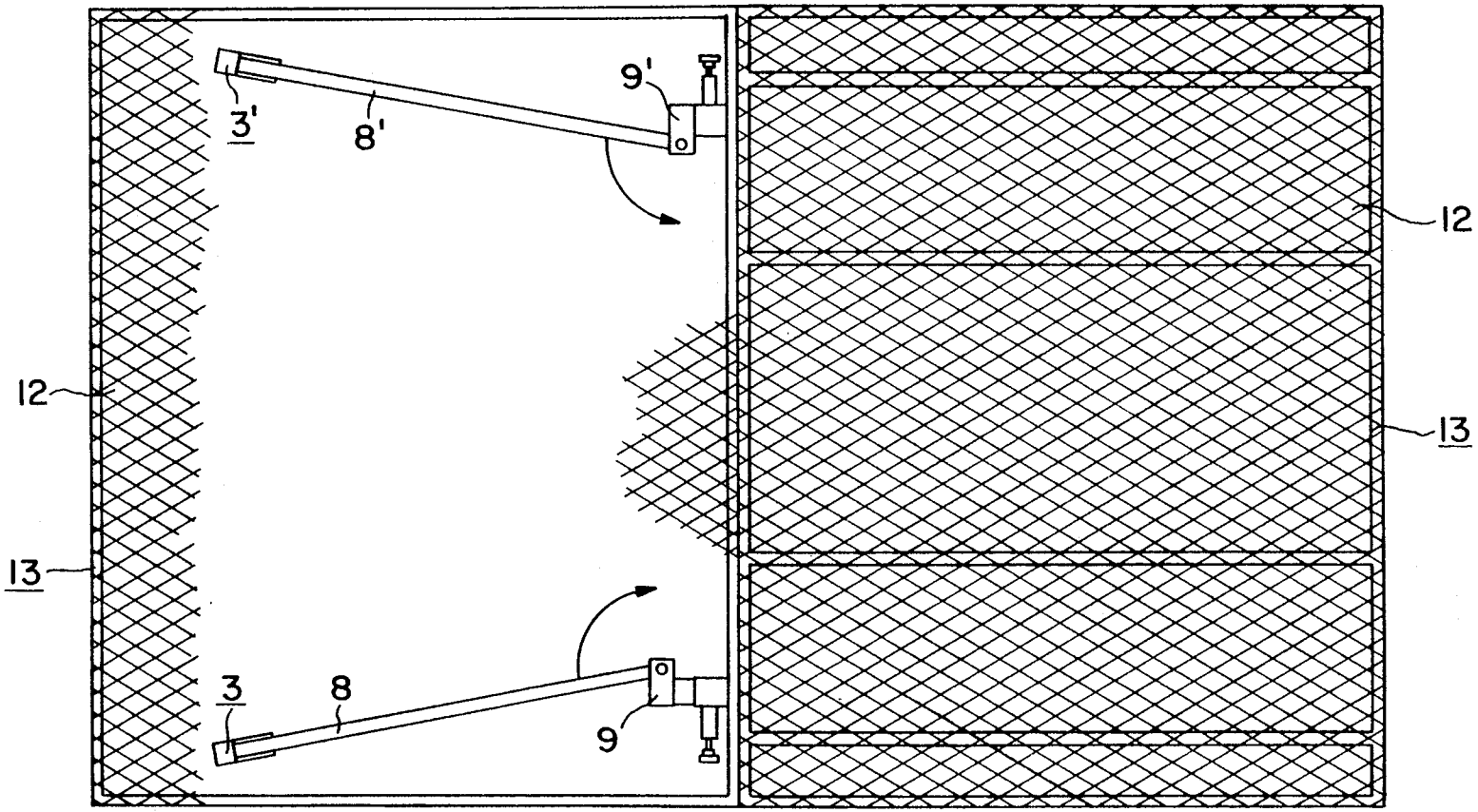
FIG. 4 is a top view of the assembled workbench.

Hinges 9 and 9' are mounted on horizontal bars 8 and 8', which connect the two telescopic posts 2 and 2', and side frame sections are mounted to these hinges 9 and 9'. As shown in FIG. 4, with these hinges, the two side frames can fold towards the rear frame (as indicated by arrows) in a manner that one side frame section (the lower side frame in the drawing) is brought on the other side frame section (the upper side frame in the drawing).

A brace 10 is horizontally installed between the top portions of the two telescopic posts 2 and 2' (which form the rear frame). The posts 2 and 2' are thus connected to each other.

Brackets 11 and 11' are horizontally installed near the upper end of the posts 2 and 2'. A top panel 12 which is covered with expanded metal is pivot-mounted to the brackets 11 and 11'.

With the above-described elements, a unit bench 13 is obtained.

Figure 3:
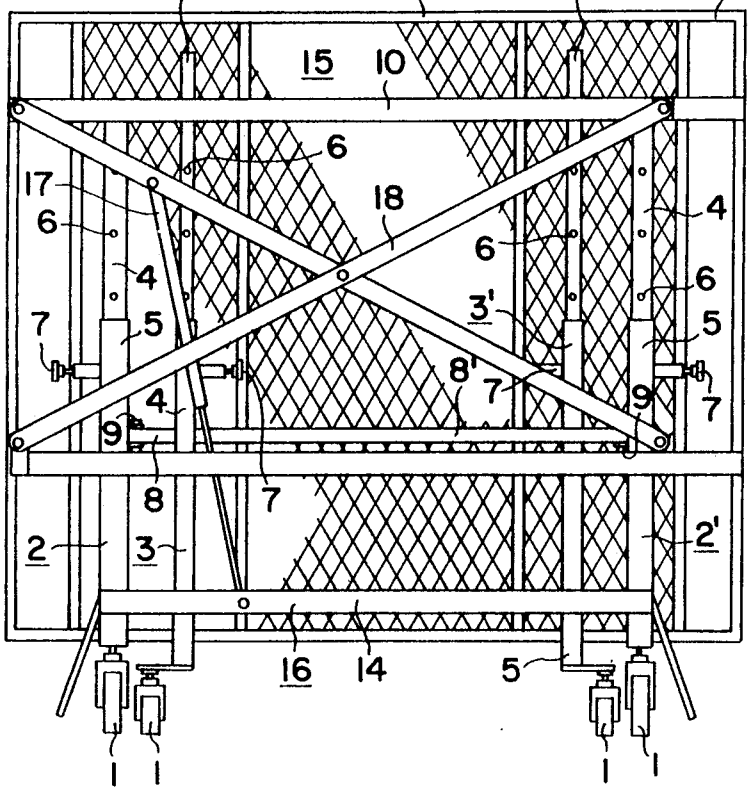
FIG. 3 is a side view taken along the line 3—3 of FIG. 1.

Two of these unit benches 13 are then connected in a back-to-back fashion (or connected via the rear frame sections), with the corresponding braces 10 and horizontal bars 14 connected (by bolts, etc.) into a single integral part. The two upper braces 10 form a "head brace 15," and the lower horizontal bars 14 form a "foot brace 16." As best seen in FIG. 3, a diagonal brace frame 18 which is equipped with a gas spring 17 is installed between the head brace 15 and foot brace 16.

Figure 1:
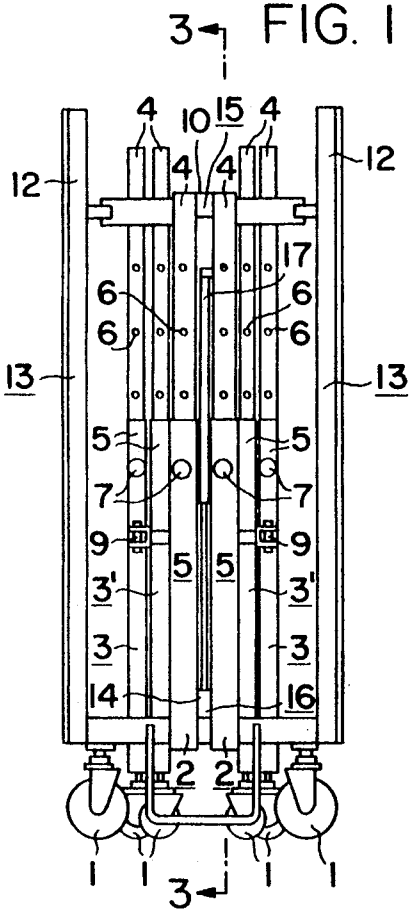
FIG. 1 is a front view of the workbench of the present invention in a folded state.

The thus constructed workbench is used in the following manner:

FIG. 1 shows the folded workbench. When used, the workbench is assembled in the following manner:

One of the two top panels 12 which has been folded in the direction of "−" moment about the hinges 9 and 9' is lifted in the direction of "+" moment (or in the upward direction) until it reaches a horizontal position. In other words, the lowest end of the top panel 12 is rotated upward about the end portion of the braces 11 and 11'.

Afterward, the two side frames which have been folded one above the other on the rear frame are opened so that the overall frame forms into U shape when viewed from the above. Then, the raised top panel 12 is supported on the tops of the two telescopic posts 3 and 3'.

By the same process, the other top panel 12 of the other unit bench is raised and positioned on the telescopic posts 3 and 3' as shown in FIG. 2. Thus, a workbench is assembled with the top panels 12 in a horizontal position.

The height of the thus assembled workbench is set by inserting the bolts 7 into respective latch holes 6 of the inner cylinders 4 so that the telescopic posts 2, 2', 3 and 3' are all the same height.

When the assembled workbench is brought back to be folded as shown in FIG. 1, such a folding operation is performed with the telescopic posts 2, 2', 3 and 3' at the maximum height limit. Accordingly, when the top panels 12 are raised during the assembly step of the workbench, the top panels 12 will always be positioned at the maximum height limit.

The height adjustment (or the height change) of the workbench is performed after unfolding or assembling the workbench. In the assembled state, the telescopic posts 2 and 2' are extended to the maximum height limit, and such a height level is maintained by the diagonal brace frame 18 which is jacked up by the gas spring 17. In particular, the two upper supporting points of the diagonal brace frame 18 are pivot-mounted to the head brace 15, while the two lower supporting points of the diagonal brace frame 18 are pivot-mounted to the foot brace 16. In addition, one end of the gas spring 17 is pivot-mounted to a portion of the diagonal brace frame 18, while the other end of gas spring 17 is pivot-mounted to the foot brace 16. Thus, a reaction force is maintained.

When the bolts 7 are disengaged so as to lower the top panels 12, the top panels 12 tend to drop by their own weight. However, as described above, since the top panels 12 are kept jacked up by the diagonal brace frame 18 and by the gas spring 17, the workbench surfaces 12 will not drop by their own weight alone. Accordingly, the top panels 12 are pushed down to a desired height. When they are lowered to the desired height, the bolts 7 on the respective telescopic posts 2, 2', 3 and 3' are brought back into the latch holes 6. Thus, the respective telescopic posts are fixed in height, and the top panels 12 are set at a desired height. When the workbench is folded, above-described operation is performed in reverse.

When the workbench is folded, the left and right top panels 12 are respectively folded in the direction of "—" moment (downward) about the brackets 11 and 11' as shown in FIG. 1. As a result, the telescopic posts and the diagonal brace frame 18 folded top panels 12. Thus, surfaces which are suitable for horizontal stacking of the folded workbenches are formed on both sides of each workbench.

Figure 5:
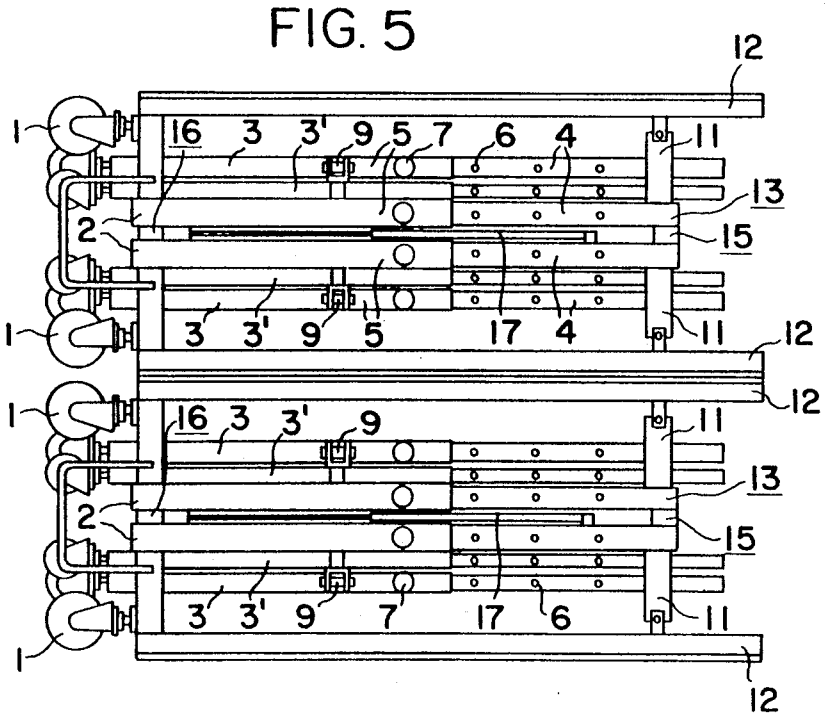
FIG. 5 is a front view of the folded workbench stacked one on the other horizontally.

As described above, according to the present invention, the height-adjustable and foldable workbench is constructed in a simple structure with a small number of assembly parts. When folded, a plurality of workbenches are stored in an upright position or, as shown in FIG. 5, in a horizontally stacked position with one above the other.

What is claimed is:

1. A foldable workbench comprising a pair of unit workbenchs each workbench comprising:

a U-shaped frame comprising one rear frame section and two side frame sections formed with four telescopic posts and lateral bars that connect said posts;

hinges installed on said lateral bars which connect said telescopic posts, said two side frame sections being pivotally mounted to said hinges so as to be brought one on the other when folded, a brace horizontally installed between upper parts of said two telescopic posts of said rear frame section so as to connect said posts to each other, brackets horizontally installed to said upper parts of said telescopic posts, and a top panel pivotally mounted to said brackets, whereby a pair of said unit benches are connected in a back-to-back fashion, with corresponding braces and horizontal bars connected into single integral part, forming a head brace and a foot brace, respectively, and a gas-spring-equipped diagonal brace frame is installed between said head brace and foot brace.

* * * * *